US006257145B1

(12) United States Patent
Wardecki

(10) Patent No.: US 6,257,145 B1
(45) Date of Patent: Jul. 10, 2001

(54) PYROTECHNICAL IMPACT DETONATOR

(75) Inventor: Norbert Wardecki, Heuweiler (DE)

(73) Assignee: Buck Neue Technologien GmbH, Schneizlreuth (DE)

( * ) Notice: Subject to any disclaimer, the term of this patent is extended or adjusted under 35 U.S.C. 154(b) by 0 days.

(21) Appl. No.: 09/178,815

(22) Filed: Oct. 26, 1998

(30) Foreign Application Priority Data

Oct. 24, 1997 (DE) ..... 197 47 183

(51) Int. Cl.[7] ..... C06C 7/00

(52) U.S. Cl. ..... 102/204; 102/272; 102/265; 102/266

(58) Field of Search ..... 102/204, 272, 102/499, 500, 265, 266, 269, 273

(56) References Cited

U.S. PATENT DOCUMENTS 415,719 * 11/1889 Langfitt ..... 102/272
1,221,454 * 4/1917 Keller ..... 102/272
2,462,305 * 2/1949 Catlin ..... 102/272
2,627,810 * 2/1953 Catlin ..... 102/272

* cited by examiner

*Primary Examiner*—Charles T. Jordan
*Assistant Examiner*—Kevin Jakel
(74) *Attorney, Agent, or Firm*—Burns, Doane, Swecker & Mathis, LLP

(57) ABSTRACT

A projectile includes a pyrotechnical detonation chain arranged to be ignited in response to a launching of the projectile. The chain includes two successive spaced-apart portions that are spaced apart to prevent ignition from being transferred therebetween. One of the portions is movable into contact with the other. A holder imposes a yieldable retaining force (e.g., friction, or shear pin) against the movable portion. That force can be overcome by momentum of the movable portion when the projectile strikes a target, whereupon the movable portion moves into contact with, and ignites, the other portion.

8 Claims, 3 Drawing Sheets

PYROTECHNICAL IMPACT DETONATOR

BACKGROUND OF THE INVENTION

The present invention relates to an impact detonator for a projectile for the detonation of an active mass upon impact against an obstacle.

The known impact detonators have a high danger potential, mainly due to the possibility of the existence of a dud. This is because, especially upon impact on soft ground, if there is no detonation of the active mass, then a dud will exist, of which the active mass is basically still ignitable.

For the reduction of this danger potential of these conventional impact detonators, the use of self-disintegrating devices connected in parallel are known, while, however, these cannot eliminate any residual risk.

Of course, the danger potential of known impact detonators can be avoided by relinquishing their use entirely and instead using pyrotechnical detonation delay devices. While this has the advantage that potential duds pose no direct danger, since, with the extinguishing of the detonation delay devices, no active detonation element is available. While, however, also the disadvantage exists that the initialization of the active charge appears only upon passing of the delay period, and not already upon impact against the ground.

SUMMARY OF THE INVENTION

It is thus the object of the present invention to develop the known impact detonator such that, upon impact against an obstacle, a detonating function is introduced with a simultaneous avoidance of a danger in handling the corresponding projectiles, such as during manufacture, assembly or disassembly and/or defusing, especially in the case of duds.

According to the invention, the problem is solved through the use of a detonation chain which comprises a pyrotechnical detonation means, wherein the pyrotechnical mass and the pyrotechnical detonation means, as movable with respect to one another, are held spacially separated from one another, at least prior to the impact of the projectile against an obstacle, and can move towards one another upon impact of the projectile against an obstacle for the detonation of the active mass.

In so doing, it can be provided that the pyrotechnical mass is an ignition charge, such as $Si/Pb_3O_4$ or the like.

An embodiment of the invention is characterized in that a first delay piece is connected to the pyrotechnical mass, especially if the projectile can be detonated upon discharge.

Further, according to the invention, it is suggested that the pyrotechnical mass or the first delay piece can be detonated either electrically, such as using a detonation initiator, a detonator or the like, or pyrotechnically, such as using a propelling charge swath of gun powder or the like upon discharge or ejection of the projectile.

It can be provided that the pyrotechnical detonation means comprise the active mass or a second detonation charge and the active mass.

Preferred, according to the invention, is that the pyrotechnical mass is held apart from the pyrotechnical detonation means by a frictional retaining force which allows for a relative movement only upon application of a certain pressure from the mass.

Equally preferred is that the movable storage of the pyrotechnical mass with respect to the pyrotechnical detonation means comprises a design memory element or a fuse which allows for a relative movement only upon supply of a certain amount of heat.

The holding of the pyrotechnical mass can be achieved by shear pins.

A further embodiment of the invention is characterized by a second delay piece, after the delay period of which the self-destruction of the projectile is introduced.

In so doing, the invention suggests that the delay period of the second delay piece be longer that the delay period of the first delay piece.

According to the invention, it can be provided that a second delay piece of the pyrotechnical mass is connected in the detonation chain or is added in parallel.

Finally, it is suggested further that the first and/or second delay piece represents a mechanical or electronic time-delay fuse.

Thus, the basis of the invention is the surprising recognition that a pyrotechnical impact detonator has a pyrotechnical mass which, for example, upon discharge of the projectile or upon ejection of a projectile's internal structure is detonated and made to spark, optionally also after a defined period of delay, and, in the case of the normal operation through the shock of the impact from a position fixed until then, is moved in the direction of a detonation means which, in regard to the detonation chain, is located behind it, detonates it and thus triggers the function of the projectile, or in the case of a dud finishes sparking in said position, such that the detonation chain to the active mass, due to the failure of a connecting part cannot be put into operation by itself, that is, the dud can be, for example, buried in a safe condition. According to the invention, the pyrotechnical mass can be installed tightly in one location, while the detonation means is stored as movable.

Furthermore, according to the invention, mechanical or electronic time-delay fuses can, according to the invention, be provided in a pyrotechnical impact detonator which guarantees a outstripping safety, detonates the pyrotechnical mass as well as keep it ready for impact function over a certain period of time and/or induce self-destruction.

A pyrotechnical impact detonator, according to the invention, can be employed in a variety of ways, for example, in a bomblet projectile, a mortar shell or practice ammunition of any caliber.

BRIEF DESCRIPTION OF THE DRAWINGS

Further characteristics and advantages of the invention are illustrated in the following description in which embodiment examples of the invention are explained in detail using schematic diagrams. Thus.

BRIEF DESCRIPTION OF A PREFERRED EMBODIMENT OF THE INVENTION

Figure 1:
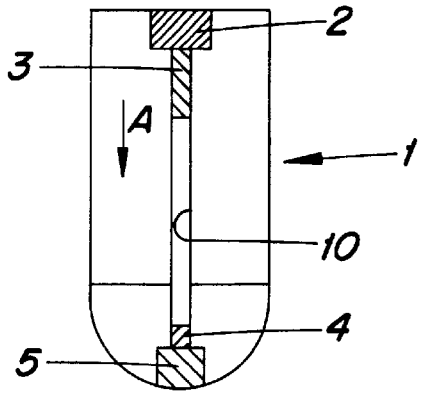
FIG. 1 shows a cross-sectional view of a projectile with a pyrotechnical impact detonator, according to the invention.

A projectile 1 with an impact detonator, according to the invention, comprises, according to FIG. 1, a detonation chain, having a first detonation charge 2, a pyrotechnical mass 3, a second detonation charge 4 as well as an active charge 5. Such a projectile, for example, a practice ammunition with a cellulose nitrate charge as active mass has the following functional process with the pyrotechnical impact detonator, according to the invention:

The detonation charge 2 is detonated after the discharge of the practice projectile 1, for example, through the fire of the ejection charge, in order to, in turn, spark the pyrotechnical mass 3 with a certain time delay.

As soon as the practice projectile 1 impacts an obstacle, there are two possibilities. On the one hand, the pressure that is generated at impact can be large enough to loosen the temporary fixation of the pyrotechnical mass 3 in the projectile 1, e.g., overcome a frictional retaining force, between the mass 3 and a wall of a passage 10 in which the mass is held, so that the pyrotechnical mass 3 can move towards the detonation charge 4 in direction of the arrow A, to detonate via the active charge 5. On the other hand, the pressure of the impact can be too small to loosen said fixation, so that the pyrotechnical mass 3 is kept at its well-defined distance from the detonation charge 4, finishes to spark and thus, after cooling down, is inactive. Therefore, even a dud does not pose a danger due to the irreversible disruption of the detonation chain, so that the active charge 5 can, for example, be simply disarmed or recycled without risk.

Figure 2:
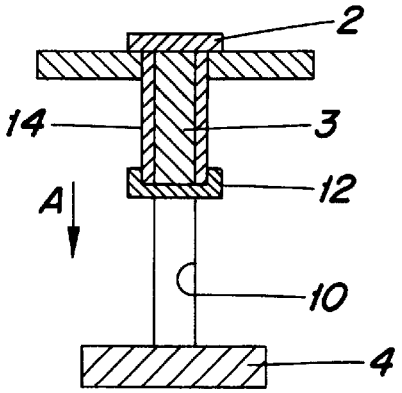
FIG. 2 shows a partial cross-sectional view of a pyrotechnical impact detonator according to a first embodiment of the invention.
Figure 3:
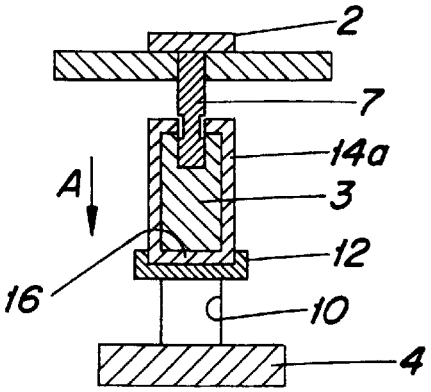
FIG. 3 shows a partial cross-sectional view of a pyrotechnical impact detonator according to a second embodiment of the invention.
Figure 4:
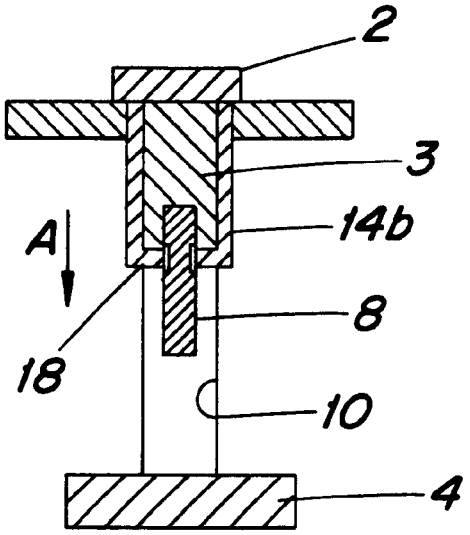
FIG. 4 shows a partial cross-sectional view of a pyrotechnical impact detonator according to a third embodiment of the invention.
Figure 5:
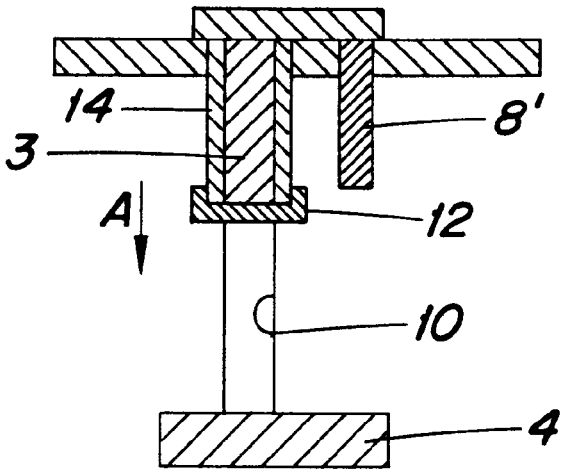
FIG. 5 shows a partial cross-sectional view of a pyrotechnical impact detonator according to a fourth embodiment of the invention.
Figure 6:
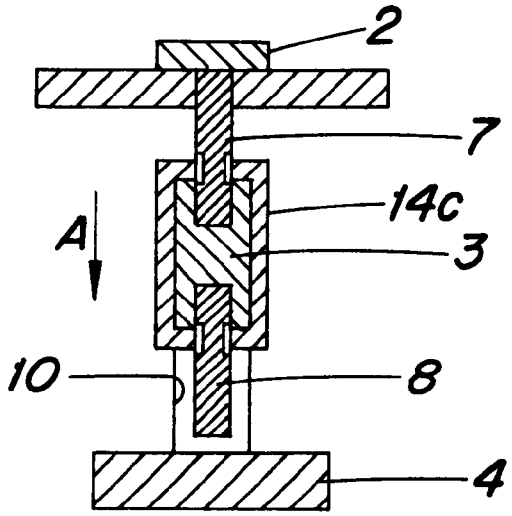
FIG. 6 shows a partial cross-sectional view of a pyrotechnical impact detonator according to a fifth embodiment of the invention.
Figure 7:
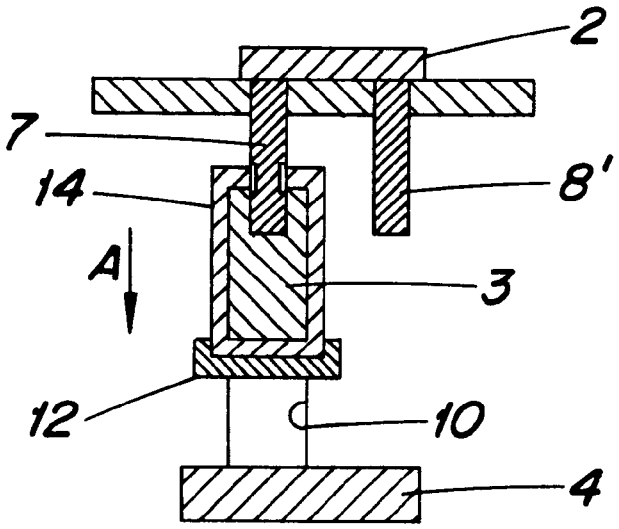
FIG. 7 shows a partial cross-sectional view of a pyrotechnical impact detonator according to a sixth embodiment of the invention.

FIG. 2 again shows schematically the main parts of the pyrotechnical impact detonator of FIG. 1, according to the invention, with a heat-fusible element 12 provided which is consumable by heat transmitted from the charge 2 via tube 14, in order to release the mass 3 for movement toward the charge 4. The pyrotechnical impact detonators of FIGS. 3 to 7, thus, deviate from that of FIG. 2 due to the use of one or two time-delay fuses. Thus, according to FIG. 3, a first delay piece 7 is provided, which is especially useful at the detonation of the projectile during discharge, to guarantee flight safety, to detonate the pyrotechnical charge and keep the same functionally ready for a certain period of time. The heat-fusible element 12 is also provided, and the bottom 16 of the tube 14*a* can also be fusible. The delay piece 7 postpones the moment at which the mass 3 is ignited. Connected to the pyrotechnical impact detonator, according to FIG. 4, is a second delay piece 8 of the pyrotechnical mass 3, to trigger self-destruction in duds after a predetermined period of time. The delay piece 8, which is retained in the fusible bottom 18 of a tube 14*b*, prolongs the period that there exists a burning mass that is available to ignite the charge 4, i.e., the piece 8 burns even after the mass 3 is extinguished. The mode of operation of the pyrotechnical impact detonator, according to FIG. 5, is not basically different from that according to FIG. 4, that is, it is basically irrelevant for the self-destruction whether the second delay piece 8, 8' of the pyrotechnical mass 3 is connected or is added in parallel. In the embodiments of FIG. 6, provided is a first delay piece 7 as well as a second delay piece 8, both being mounted in a tube 14*c*. The upper time delay piece 7 delays the moment at which the mass 3 is ignited, as in FIG. 3, whereas the delay piece 8 prolongs the period at which there exists a burning mass, as in FIG. 4. FIG. 7 is similar to FIG. 3 with the addition of a parallel delay piece 8' as in FIG. 5.

The characteristics of the invention which are disclosed in the above description, in the diagrams as well as in the claims can apply singly as well as in random combination for the realization of the invention in its various embodiments.

What is claimed is:

1. A projectile comprising a pyrotechnical detonation chain arranged to be ignited in response to a launching of the projectile and including two successively arranged pyrotechnical portions spaced apart from one another, one of the portions comprising a movable portion that can move in a direction toward the other portion, a holder arranged for imposing against the movable portion a yieldable retaining force that can be overcome by a momentum of the movable portion in response to the projectile striking a target, to enable the movable portion to move into contact with, and ignite, the other portion.

2. The projectile according to claim 1 wherein the holder comprises a passage, the yieldable retaining force comprising a frictional force between the movable portion and a wall of the passage.

3. The projectile according to claim 1 wherein the movable portion comprises $Si/Pb_3O_4$.

4. The projectile according to claim 1 wherein the pyrotechnical detonation chain further comprises a first detonation charge arranged to be ignited upon the launching of the projectile and to ignite the movable portion, and an active charge arranged to be ignited by the said other portion.

5. The projectile according to claim 1 further including a time delay piece arranged for igniting the movable portion after a delay.

6. The projectile according to claim 5 wherein the first delay piece comprises a first delay piece, and wherein the movable portion comprises a second time delay piece for prolonging an ignition period of the movable portion.

7. The projectile according to claim 1 wherein the movable portion comprises a time delay piece arranged to prolong an ignition period of the movable portion.

8. The projectile according to claim 1 further comprising a heat-fusible element arranged to block movement of the movable portion toward the other portion.

* * * * *